United States Patent [19]

Mayer et al.

[11] 4,451,262

[45] May 29, 1984

[54] AFTER-TREATMENT OF FINISHED, CELLULOSE-CONTAINING FIBROUS MATERIALS WITH LIQUID AMMONIA

[75] Inventors: Fritz Mayer, Weil am Rhein, Fed. Rep. of Germany; Svein Holtermann, Oslo, Norway

[73] Assignee: Ciba-Geigy Corporation, Ardsley, N.Y.

[21] Appl. No.: 338,724

[22] Filed: Jan. 11, 1982

Related U.S. Application Data

[63] Continuation of Ser. No. 138,067, Apr. 7, 1980, abandoned.

[30] Foreign Application Priority Data

Jul. 16, 1979 [CH] Switzerland ..... 6607/79

[51] Int. Cl.[3] ..... D06M 13/28; D06M 13/32; D06M 13/44; D06M 11/14

[52] U.S. Cl. ..... 8/125; 8/116 P; 8/490; 8/619

[58] Field of Search ..... 8/125, 490, 493, 619, 8/116 P

[56] References Cited

U.S. PATENT DOCUMENTS 2,158,494 5/1939 Corteen et al. ..... 8/125
2,988,416 6/1961 Wood ..... 8/125
3,406,006 10/1968 Lindberg et al. ..... 8/125
3,498,739 3/1970 Murphy et al. ..... 8/125

FOREIGN PATENT DOCUMENTS 159688 11/1954 Australia ..... 8/125

OTHER PUBLICATIONS

Mazzeno et al., Amer. Dyestuff Reporter, Oct., 1957.
Reinhardt et al., Jour. of Textile Chem. & Colorist Nov. 3, 1958.
Perkins et al., Textile Management & Engineering Journal (Textile Industries reprint 1/66).
Trask et al., Textile Chem. & Colorist, Oct., 1977.

*Primary Examiner*—Maria Parrish Tungol
*Attorney, Agent, or Firm*—Edward McC. Roberts

[57] ABSTRACT

A process for finishing cellulose-containing fibrous material, in which (a) commercially available textile finishing agents are applied to the fibrous material and fixed, (b) the material is subsequently washed and dried, if necessary, and (c) the textile material is after-treated with liquid ammonia.

As a result of the after-treatment with liquid ammonia, the mechanical properties of the finished fibrous material, from the textile point of view, and in particular the tear strength and the handle, are considerably improved.

19 Claims, No Drawings

AFTER-TREATMENT OF FINISHED, CELLULOSE-CONTAINING FIBROUS MATERIALS WITH LIQUID AMMONIA

This is a continuation of application Ser. No. 138,067, filed on Apr. 7, 1980 now abandoned.

The present invention relates to the after-treatment of finished, cellulose-containing fibrous materials with liquid ammonia.

The treatment of cellulose-containing fibrous material with liquid ammonia has experienced a great upsurge in recent years. With this treatment, the effect of hot mercerisation (in this context cf., for example, information leaflet no. 5 in the series on the "Behandlung von Baumwolle mit Quellmitteln" ("Treatment of Cotton with Swelling Agents") by K. Bredereck in Melliand Textilberichte (Melliand textile reports) 8/1978, pages 648–653) is achieved in a simple and inexpensive way. Hitherto, mercerisation and the liquid ammonia treatment method have always been used for the pretreatment of cellulose-containing fibrous materials, i.e. prior to dyeing and finishing. However, the fibrous materials pre-treated with liquid ammonia cannot be provided with a finish in a completely satisfactory manner using textile finishing agents. For example, with most of the recipes for flameproofing agents, which are usually applied in order to obtain permanent effects, only an inadequate degree of fixing of the finishing agent onto the fibres pre-treated with liquid ammonia can be achieved, so that it has to be accepted that the permanence of the flameproof finish will be poorer. Moreover, many cellulose-containing fibrous materials pretreated with liquid ammonia and subsequently finished with flameproofing agents have an unpleasant, stiff handle.

Unexpectedly, these disadvantages are avoided according to the invention, by finishing the cellulose-containing material in a first stage with a textile finishing agent, subsequently washing, if necessary, in a second stage and then, in a third stage, subjecting the material to after-treatment with liquid ammonia.

The invention therefore relates to a process for finishing cellulose-containing fibrous material, which may have been dyed and whitened, which comprises (a) applying at least one textile finishing agent to the fibre and fixing, (b) if necessary subsequently washing and drying the material and (c) subjecting the material thus obtained to an after-treatment with liquid ammonia.

The present invention also relates to a process for the after-treatment of cellulose-containing, finished fibrous materials, which may have been dyed and whitened and to which at least one textile finishing agent has previously been applied and fixed, the fibrous materials subsequently having been washed and dried if necessary, which comprises using liquid ammonia for the after-treatment.

Further subjects of the present invention are the use of liquid ammonia for the after-treatment of cellulose-containing, finished fibrous material, which may have been dyed and whitened, and the cellulose-containing, finished fibrous material, which may have been dyed and whitened, which has been after-treated with liquid ammonia by the process according to the invention.

The textile finishing agents used in stage (a) of the process according to the invention are the commercially available textile finishing agents. Thus, inter alia, commercially available crease-resistant agents, shrinkresistant agents, agents for providing wet strength, agents for providing a soft handle, agents which impart hydrophobic properties, agents which impart oleophobic properties, and/or flameproofing agents are employed.

The finishing agents preferably employed are crease-resistant agents, agents for providing a soft handle, agents which impart hydrophobic properties or, in particular, flameproofing agents, or mixtures of these finishing agents, such as agents which impart hydrophobic properties together with agents which impart oleophobic properties, or flameproofing agents together with crease-resistant agents, agents which impart hydrophobic properties and/or agents which provide a soft handle. Various finishing agents for the same purpose, for example various commercially available crease-resistant agents, agents for imparting hydrophobic properties or agents for imparting oleophobic properties, can also be used together.

These finishing agents have very diverse chemical constitutions. Thus, for example, fluoroalkyl phosphates and/or fluoroalkyl methacrylates are used as agents for imparting hydrophobic properties and/or as agents for imparting oleophobic properties, aminoplast precondensates, which can be modified with a fatty acid and etherified, are used as crease-resistant agents, agents for imparting hydrophobic properties and/or agents for providing a soft handle, and/or methylolated phosphonium salts or phosphonium hydroxides or their water-soluble condensation products with compounds which form aminoplasts, or methylolated alkylphosphonic acid amides or their water-soluble polymers or copolymers with compounds which form aminoplasts, are used as flameproofing agents.

In this specification, compounds which form aminoplasts are understood as meaning nitrogen compounds which can be methylolated, preferably those of the urea and s-triazine series. Examples of such nitrogen compounds are cyanamide, dicyandiamide, guanidine, biuret, urethane, alkylene- or propylene-urea, which can be substituted by hydroxyl, ethylenediurea and preferably urea itself and unsubstituted ethyleneurea, and also cyanuric acid, ammeline, ammelide, acetoguanamine, benzoguanamine, acetoguanide, acetoguanamide, urone and oxodiazine, preferably triazone and triazine and in particular melamine.

According to the invention, aminoplast precondensates are understood as meaning the adducts of formaldehyde with these methylolated nitrogen compounds. Preferred aminoplast precondensates are thus, for example, a methylolated urea or ethyleneurea or a methylolated triazine or melamine.

Textile finishing agents preferably employed are mono- or bis-(fluoroalkyl)-ammonium phosphates having 6 to 24 fluorine atoms and 4 to 28 carbon atoms per fluoroalkyl radical, fluoroalkyl methacrylates having 4 to 15 fluorine atoms and 5 to 16 carbon atoms in the fluoroalkyl radical and/or condensation products of stearic acid with a methylolated melamine etherified with methyl or ethyl, as agents which impart hydrophobic or oleophobic properties, condensation products of a urea/stearic acid adduct with a methylolated ethyleneurea substituted by hydroxyl and/or with a triazone substituted by methyl or ethyl, as crease-resistant agents, condensation products of a methylolated stearic acid amide with a methylolated melamine etherified by methyl or ethyl, as agents which provide a soft handle, and/or tetrakis-(hydroxymethyl)-phosphonium salts or their condensation products with urea or a N-methylolated dimethyl- or diethyl-phosphono-propionamide, as flameproofing agents.

Examples of specific representatives of agents which impart oleophobic properties and of agents which impart hydrophobic properties are, inter alia, bis-(perfluoroalkylmethyl)-, bis-(1H,1H-pentadecafluorooctyl)- and bis-(1H,1H,9H-hexadecafluorononyl)-ammonium phosphate and also 1H,1H,2H,2-heptadecafluorodecyl methacrylate and similar fluorine compounds, which are described, for example, in British Pat. Nos. 939,902, 971,732, 1,010,539 and 1,011,612.

An example of a specific agent which imparts hydrophobic properties is, inter alia, a condensation product of stearic acid with hexamethylolmelamine hexamethyl ether, an example of a specific agent which provides a soft handle is, inter alia, a condensation product of stearic acid methylolamide with hexamethylolmelamine hexamethyl ether and an example of a specific crease-resistant agent is, inter alia, a condensation product of a reactive stearylurea derivative with a mixture of dimethyloldihydroxy-ethyleneurea and dimethylolmethyltriazone. Examples of specific flameproofing agents are, inter alia, tetrakis-(hydroxymethyl)-phosphonium chloride, tetrakis-(hydroxymethyl)-phosphonium sulfate or tetrakis-(hydroxymethyl)-phosphonium hydroxide, a condensation product of tetrakis-(hydroxymethyl)-phosphonium chloride with urea or self-condensation products of tetrakis-(hydroxymethyl)-phosphonium chloride or tetrakis-(hydroxymethyl)-phosphonium hydroxide, which are described, for example, in British Patent Specifications 1,075,033, 1,545,793 and 1,453,296 and, inter alia, in particular O,O'-dimethyl-N-hydroxymethyl-phosphonopropionamide, which is of primary interest and is described, for example, in German Patent Specification 1,469,281.

The textile finishing agents are as a rule employed in the form of commercially available aqueous formulations. Such formulations are preferably in the form of aqueous emulsions and in particular of aqueous solutions which, before use, are diluted with water to give aqueous preparations and are applied to the fibrous materials. Such formulations or preparations can contain a compound which forms an aminoplast, or an aminoplast precondensate, of the type already indicated, in addition to the finishing agents which can be used, in particular when the finishing agent employed is a flameproofing agent containing phosphorus.

Compounds which form aminoplasts or aminoplast precondensates preferably used for this purpose are, for example, ureas or melamines, which can be methylolated and etherified with methyl or ethyl, in particular dimethylolurea, di- and tri-methylolmelamine and hexamethylolmelamine hexamethyl ether.

In a particularly preferred embodiment of the process according to the invention, the aqueous preparation employed, which contains the textile finishing agent, is a N-methylolated O,O'-dimethyl- or -diethyl-phosphonopropionamide, in particular O,O'-dimethyl-N-hydroxymethylphosphonopropionamide, as a flameproofing agent, in the presence of a methylolated melamine, which can be etherified with methyl or ethyl, in particular a mixture of di- and tri-methylolmelamine or hexamethylolmelamine hexamethyl ether, as an aminoplast precondensate.

As a rule, the aqueous preparations which are applied to the fibrous material contain 50 to 500 g/l of a finishing agent and 0 to 100 g/l of a compound which forms an aminoplast or an aminoplast precondensate, and in particular 200 to 400 g/l of a flameproofing agent as the finishing agent and 20 to 100 g/l of an aminoplast precondensate.

These aqueous, dilute preparations usually have an acid to neutral or weakly alkaline pH value, as a rule of 2 to 7.5 and preferably 4 to 7; if necessary, the pH is adjusted to this value in the customary manner by the addition of a base or acid.

In addition to a compound which forms an aminoplast or an aminoplast precondensate, the aqueous preparations of the textile finishing agents can, if desired, also contain further additives. For example, an addition of 0.1 to 0.5 g/l of preparation of a high molecular weight polyethylene glycol is advantageous in order to obtain a thicker coating of substance on fabrics. Other conventional plasticisers, for example an aqueous polyethylene or silicone oil emulsion, can also be added to the preparations.

In order to improve the mechanical strength characteristics of the fibres, it is also possible to add suitable copolymers to the preparations, for example copolymers of N-methylolacrylamide or cationic copolymers.

An addition of curing catalysts or so-called latent acid catalysts, for example ammonium chloride, ammonium dihydrogen orthophosphate, phosphoric acid, magnesium chloride, zinc nitrate or 2-amino-2-methyl-1-propanol hydrochloride, can frequently prove advantageous.

The same also applies in the case of addition of buffer substances, for example sodium bicarbonate, di- and tri-sodium phosphate or triethanolamine.

In order to improve the stability of the finishes with the textile finishing agents and to effect a particularly soft handle, it can be advantageous to add halogenated paraffins, if desired in combination with a polyvinyl halide compound, to the aqueous preparations.

Furthermore, the aqueous preparations can also contain proportions of organic solvents, which serve, in particular as solubilising agents for the plasticiser, for example dioxan, acetone, n-butylglycol, isopropanol, ethanol or ethyl acetate.

Furthermore, it can be advantageous to add small amounts (for example 0.5 to 2 g/l) of wetting agents to the preparations, for example non-ionic adducts of ethylene oxide with an alkylphenol, such as a condensation product of 1 mol of p-tert.-nonylphenol and 6 to 12 mols of ethylene oxide.

The aqueous preparations of the textile finishing agents are applied to the fibrous materials in a manner known per se. Thus, the fibrous materials are impregnated with the aqueous preparations by, for example, spraying, flop-padding or immersing. Preferably, however, piece goods are used and these are impregnated on a padder which is charged with the preparation, as a rule at room temperature. In addition to this preferred padding method, the exhaust method can also be used.

After the textile finishing agents have been applied to the fibrous material, they must now be fixed on the fibrous material. This fixing can be effected by various methods, for example by the so-called damp storage or wet storage method, by the ammonia fixing method or by the thermofixing method.

If the wet fixing method is used, the completely wet fibrous material is stored for 12 to 48 hours at about 40° to 60° C., rinsed and washed if necessary and then dried at about 60° to 100° C. The procedure for the damp fixing method is similar, except that the wet fibrous material is dried to a residual moisture content of about 2 to 20% before storing. With the ammonia fixing method, the treated fibrous material is first treated, in the damp state, with ammonia gas, as a result of which the temperature rises by itself to temperatures of, for example, up to 80° C., or is rinsed in an ammonia solution at 20° to 80° C. and preferably 20° to 40° C. and then dried, for example at 60° to 100° C.

The ammonia fixing method is preferred to the damp storage or wet storage method. However, the so-called thermofixing method is of primary interest.

With this thermofixing method, the impregnated fibrous material is dried and subjected to a heat treatment. Advantageously, the material is dried at temperatures of up to 100° C., for example at 60° to 100° C. The material is then subjected to a heat treatment at temperatures above 100° C., for example at 100° to 200° C. and preferably at 130° to 180° C., and the heat treatment period can be shorter the higher the temperature. The heating period lasts, for example, from 30 seconds to 10 minutes.

After fixing the textile finishing agent on the fibrous material, the material is, if desired, washed and again dried in the optional stage (b) of the process according to the invention. This subsequent washing is carried out, in particular, if a phosphorus-containing flameproofing agent has been used as the textile finishing agent. Since phosphorus-containing flameproofing agents are as a rule applied from acid aqueous preparations, subsequent washing of the flameproof finish on the fibrous material is necessary in most cases. For this purpose, the fibrous material is washed with an aqueous solution which contains an acid-binding agent and, if desired, an oxidising agent, and the material is dried at, for example, 60° to 100° C. The acid-binding agent employed is, for example, sodium hydroxide or sodium carbonate. If the finish produced with the textile finishing agent, and in particular with the flameproofing agent, has an unpleasant residual odour, it is advantageous to add an oxidising agent, for example hydrogen peroxide, to the aqueous solution which contains the acid-binding agent. As a rule, the aqueous wash solution contains 0.1 to 0.8 and preferably 0.3 to 0.6 g/l of the acid-binding agent and 0 to 8, and preferably 3 to 6, g/l of the oxidising agent. The subsequent wash is carried out at 20° to 90° C. and preferably at 60° to 80° C.

After this subsequent wash, the material is advantageously rinsed with water at 20° to 90° C., preferably at 60° to 80° C., and dried, for example at 60° to 100° C.

The treatment of a fibrous material with liquid ammonia is described, for example, in Melliand Textilberichte (Melliand textile reports) 8/1976, page 684. The treatment must be carried out at a temperature below the boiling point of ammonia, i.e. at not higher than −33° C. (under atmospheric pressure). As a rule, the treatment is carried out in a closed apparatus, with which the ammonia is recovered in the gaseous form, liquefied and recycled to the process. An apparatus of this type is also described on page 684 of Melliand Textilberichte (Melliand textile reports) 8/1976.

Preferably, the fibrous material is subjected to an after-treatment with liquid ammonia for 0.1 to 10, and in particular for 1 to 6, seconds in the apparatus described, in which the material advantageously is padded under tension to make dimension control possible. Preferably, this tension is 0.5 to 2 daN/cm$^2$ (1 daN (deca Newton)=1 Kp). After padding, the excess ammonia is removed by the action of heat, for example dry heat, or preferably by steaming the fibrous material, if desired under a slight vacuum, and is liquefied and recovered.

After the after-treatment with liquid ammonia is complete, the textile material, in particular if this has been under tension during the after-treatment, is preferably subjected to mechanical shrinking, as is described, for example, in the Lehrbuchder Textilchemie (Textbook of Textile Chemistry) by H. Rath, Springer-Verlag 1963, pages 146 to 148.

This mechanical shrinking, which is also termed enforced shrinking or shrinkage, is carried out in suitable apparatuses, which are likewise described in the textbook by Rath and in which the fibrous material is steamed and pressed in the wet state between hot calenders. This operation is also termed sanforising. A desired shrinkage of preferably 1 to 10 percent of the length of the treated material can be achieved at high calender temperatures, preferably of 110° to 140° C.

The after-treatment, according to the invention, of fibrous materials, finished with textile finishing agents, with liquid ammonia has considerable advantages. Inter alia, the mechanical properties of the fibrous materials from the textile point of view, such as handle, tear strength and the like, are improved, without there being any adverse effect on the finishing effect and, where appropriate, its permanence. This also applies in the case of the whiteness of materials subjected to fluorescent brightening. If dyed material is used, it is even possible, under certain circumstances, to obtain an increase in the colour strength without influencing the shade.

Unless stated otherwise, the parts and percentages in the following examples are always by weight.

EXAMPLE 1

A satin of 85/15 cotton/polyester mixture which has a weight per unit area of 290 g/m$^2$ and has been dyed blue with a vat dye and a sulfur dye, is padded at 20° C., with a liquor pick-up of 70%, with an aqueous preparation which contains 400 g/l of O,O'-dimethyl-N-hydroxymethyl-phosphonopropionamide (in the form of an 80% aqueous solution), 80 g/l of hexamethylolmelamine hexamethyl ether (in the form of a 60% aqueous solution), 30 g/l of a condensation product of 1 mol of hexamethylolmelamine hexamethyl ether and 2 mols of stearic acid methylolamide (in the form of a 24% aqueous dispersion), 2 g/l of an adduct of 1 mol of nonylphenol and 10 mols of ethylene oxide (in the form of a 25% aqueous solution) and 20 g/l of an 85% phosphoric acid. The satin impregnated in this way is dried at 100° C. and then subjected to a heat treatment at 150° C. for 5 minutes. The satin is then washed at 70° C. with an aqueous 0.4% sodium carbonate solution, which can contain 3 to 6 ml of a 30 percent by volume hydrogen peroxide solution, rinsed with water at 60° C. and dried at 100° C. A portion of the satin is now padded with liquid ammonia at −35° C. in such a way that the satin, under a longitudinal stress of 1 daN/cm$^2$, remains in contact with the ammonia for 10 seconds. The satin is then steamed under a slight vacuum and dried at 100° C.

Both the satin after-treated with ammonia and the satin which has not been after-treated are flame-resistant according to the DIN 53 906 vertical test (ignition time 15 seconds), even after 40 conventional washes according to SNV 198 861. The results of the determinations of the stiffness according to ASTM D 1388-64, the tear strength according to SNV 198 461, the Elmendorf tear propagation resistance according to SNV 198

482 and of the colour strength of the satin which has not been after-treated and of the satin after-treated with ammonia are noted in Table I below. The colour strength is determined colorimetrically, the relative value of 100% being ascribed to the satin which has not been after-treated, for reference.

TABLE I

| Mechanical properties from the textile point of view and colour strength | Satin not after-treated | Satin after-treated according to the invention | Relative difference % |
|---|---|---|---|
| Tear strength | | | |
| warp/2.5 cm daN | 44.0 | 49.1 | +11.6 |
| weft/2.5 cm daN | 33.2 | 35.5 | +6.9 |
| Tear propagation resistance | | | |
| warp daN | 2.52 | 2.96 | +17.5 |
| weft daN | 2.89 | 3.60 | +24.6 |
| Stiffness mg · cm | 773 | 581 | |
| Colour strength % | 100 | 125 | |

EXAMPLE 2

The procedure of Example 1 is repeated, except that a moleskin fabric of pure cotton which has a weight per unit area of 350 g/m$^2$ and has been dyed grey with a vat dye is employed.

The results obtained from the tests to determine the flame resistance are the same as those indicated in Example 1. The mechanical properties from the textile point of view and the colour strength are tested as in Example 1 and the results are listed in Table II below.

TABLE II

| Mechanical properties from the textile point of view and colour strength | Moleskin fabric not after-treated | Moleskin fabric after-treated according to the invention | Relative difference % |
|---|---|---|---|
| Tear strength | | | |
| warp/2.5 cm daN | 29.9 | 34.4 | +15.1 |
| weft/2.5 cm daN | 47.5 | 52.0 | +9.5 |
| Tear propagation resistance | | | |
| warp daN | 2.57 | 3.46 | +34.6 |
| weft daN | 2.90 | 3.82 | +31.7 |
| Stiffness mg · cm | 1344 | 1034 | |
| Colour strength % | 100 | 136 | |

EXAMPLE 3

A poplin of pour cotton which has a weight per unit area of 180 g/m$^2$ and has been dyed grey with a vat dye is padded at 20° C., with a liquor pick-up of 65%, with an aqueous preparation which contains 400 g/l of O,O'-dimethylphosphono-N-hydroxymethyl-propionamide (in the form of an 80% aqueous solution), 60 g/l of hexamethylolmelamine hexamethyl ether (in the form of a 60% aqueous solution), 15 g/l of a condensation product of 1 mol of hexamethylolmelamine hexamethyl ether and 2 mols of stearic acid methylolamide (in the form of a 24% aqueous dispersion), 7.5 g/l of a silicone oil emulsion containing a 2-ethylhexanol/ethylene oxide adduct (in the form of a 50% aqueous emulsion) and 25 g/l of an 85% phosphoric acid. The poplin impregnated in this way is dried at 100° C. and then subjected to a heat treatment at 145° C. for 4½ minutes.

The poplin is then rinsed and dried as indicated in Example 1. A portion of the poplin is now subjected to the after-treatment with liquid ammonia, steamed and dried, as indicated in Example 1.

The results obtained from the tests to determine the flame-resistance are the same as those indicated in Example 1. The mechanical properties from the textile point of view and the colour strength are tested as indicated in Example 1 and the results are listed in Table III below.

TABLE III

| Mechanical properties from the textile point of view and colour strength | Poplin not after-treated | Poplin after-treated according to the invention | Relative difference % |
|---|---|---|---|
| Tear strength | | | |
| warp/2.5 cm daN | 20.4 | 23.5 | +15.1 |
| weft/2.5 cm daN | 16.9 | 17.7 | +4.7 |
| Tear propagation resistance | | | |
| warp daN | 0.96 | 1.30 | +35.4 |
| weft daN | 0.74 | 0.92 | +24.3 |
| Stiffness mg · cm | 284 | 121 | |
| Colour strength % | 100 | 124 | |

EXAMPLE 4

A twill of pure cotton which has a weight per unit area of 323 g/m$^2$ and has been dyed olive with a vat dye is padded at 20° C., with a liquor pick-up of 70%, with an aqueous preparation which contains 60 g/l of paraffin containing a condensation product of hexamethylolmelamine hexamethyl ether and stearic acid, 4.7 g/l of an 80% acetic acid, 450 g/l of O,O'-dimethyl-N-hydroxymethylphosphonopropionamide (in the form of an 80% aqueous solution), 60 g/l of hexamethylolmelamine hexamethyl ether (in the form of a 60% aqueous solution) and 25 g/l of an 85% phosphoric acid. The impregnated twill is dried, subjected to the heat treatment, washed, rinsed and again dried, as indicated in Example 1.

A portion of the twill is now subjected to the after-treatment with liquid ammonia, steamed and dried, as indicated in Example 1.

The results obtained from the tests to determine the flame-resistance are the same as those indicated in Example 1. In addition, the tests to determine the absorption of water, by the Bundesmann method according to DIN NO. 53 888 and according to the AATCC Spray Test 22-1971, show that both the twill after-treated with ammonia and the untreated twill are to be designated water-repellent. The mechanical properties from the textile point of view and the colour strength are tested as indicated in Example 1 and the results are listed in Table IV below.

TABLE IV

| Mechanical properties from the textile point of view and colour strength | Twill not after-treated | Twill after-treated according to the invention | Relative difference % |
|---|---|---|---|
| Tear strength | | | |
| warp/2.5 cm daN | 43.2 | 57.1 | +32.2 |
| weft/2.5 cm daN | 39.5 | 43.5 | +10.1 |
| Tear propagation resistance | | | |
| warp daN | 3.75 | 4.70 | +25.3 |
| weft daN | 5.07 | 5.93 | +17.0 |
| Stiffness mg · cm | 710 | 645 | |

TABLE IV-continued

| Mechanical properties from the textile point of view and colour strength | Twill not after-treated | Twill after-treated according to the invention | Relative difference % |
|---|---|---|---|
| Colour strength % | 100 | 114 | |

EXAMPLE 5

A twill of pure cotton which has a weight per unit area of 323 g/m$^2$ and has been dyed olive with a vat dye is padded at 20° C., with a liquor pick-up of 80%, with an aqueous preparation which contains 550 g/l of a condensation product of 2 parts of tetrakis-(hydroxymethyl)-phosphonium chloride and 1 part of urea (in the form of a 50% aqueous solution), 55 g/l of sodium acetate.3$H_2O$ (in the form of a 50% aqueous solution) and 0.5 g/l of an adduct of 1 mol of nonylphenol and 10 mols of ethylene oxide (in the form of a 25% aqueous solution). The impregnated twill is dried at 100° C. and then treated with ammonia gas for 4 minutes in a suitable, closed apparatus. In this apparatus, at least 100 l of ammonia gas per minute are fed to the twill. During this treatment, the twill warms, by itself, to 60° to 70° C. The twill is then subjected, using a liquor ratio of 1:4, to an oxidative treatment at 20° C. with a 7% aqueous hydrogen peroxide solution, the pH value of which has been adjusted to 8.0 with sodium carbonate, and, using the same liquor ratio, to an after-treatment with a 0.5% aqueous sodium carbonate solution at 50° C. and is rinsed at 50° C. and again at 20° C. and dried at 100° C.

A portion of the twill is now subjected to the after-treatment with liquid ammonia, steamed and dried, as indicated in Example 1.

The results obtained from the tests to determine the flame-resistance are the same as those indicated in Example 1. The mechanical properties from the textile point of view and the colour strength are tested as indicated in Example 1 and the results are listed in Table V below.

TABLE V

| Mechanical properties from the textile point of view and colour strength | Twill not after-treated | Twill after-treated according to the invention | Relative difference % |
|---|---|---|---|
| Tear strength | | | |
| warp/2.5 cm daN | 53.2 | 54.6 | +2.6 |
| weft/2.5 cm daN | 39.7 | 42.2 | +6.3 |
| Tear propagation resistance | | | |
| warp daN | 2.25 | 2.32 | +3.1 |
| weft daN | 2.63 | 2.73 | +3.6 |
| Stiffness mg · cm | 773 | 673 | |
| Colour strength % | 100 | 101 | |

EXAMPLE 6

The procedure of Example 5 is repeated, except that a satin of pure cotton which has a weight per unit area of 327 g/m$^2$ and has been dyed grey with a vat dye is employed.

The results obtained from the tests to determine the flame-resistance are the same as those indicated in Example 1. The mechanical properties from the textile point of view and the colour strength are tested as indicated in Example 1 and the results are listed in Table VI below.

TABLE VI

| Mechanical properties from the textile point of view and colour strength | Satin not after-treated | Satin after-treated according to the invention | Relative difference % |
|---|---|---|---|
| Tear strength | | | |
| warp/2.5 cm daN | 41.9 | 45.9 | +9.5 |
| weft/2.5 cm daN | 67.9 | 69.1 | +1.8 |
| Tear propagation resistance | | | |
| warp daN | 2.68 | 3.22 | +20.1 |
| weft daN | 4.23 | 4.95 | +17.0 |
| Stiffness mg · cm | 5312 | 4227 | |
| Colour strength % | 100 | 102 | |

EXAMPLE 7

A poplin of a 50/50 cotton/polyester mixture which has a weight per unit area of 170 g/m$^2$ and has been dyed with a vat dye and a disperse dye, is padded at 20° C., with a liquor pick-up of 60%, with an aqueous preparation which contains 130 g/l of dimethyloldihydroxyethyleneurea (in the form of a 45% aqueous solution), 130 g/l of dimethylolmethyltriazone (in the form of a 40% aqueous solution), 30 g/l of a reactive stearyl/urea adduct and 20 g/l of a 45% sulfuric acid. The poplin impregnated in this way is packed in plastic films, stored at 20° C. for 24 hours and then dried at 100° C.

A portion of the poplin is now after-treated with liquid ammonia, steamed and dried, as indicated in Example 1.

In the Monsanto crease pattern according to SNV 198 670, in which 1 is the poorest and 5 the best rating, both the poplin after-treated with ammonia and the poplin which has not been after-treated have a rating of 4. The mechanical properties from the textile point of view and the colour strength are measured as indicated in Example 1 and the results are listed in Table VII below.

TABLE VII

| Mechanical properties from the textile point of view and colour strength | Poplin not after-treated | Poplin after-treated according to the invention | Relative difference % |
|---|---|---|---|
| Tear strength | | | |
| warp/2.5 cm daN | 22.8 | 28.0 | +22.8 |
| weft/2.5 cm daN | 19.2 | 19.8 | +3.1 |
| Tear propagation resistance | | | |
| warp daN | 1.66 | 1.96 | +18.1 |
| weft daN | 1.40 | 1.67 | +19.3 |
| Stiffness mg · cm | 87 | 77 | |
| Colour strength % | 100 | 120 | |

EXAMPLE 8

A twill of pure cotton which has a weight per unit area of 300 g/m$^2$ is padded at 20° C., with a liquor pick-up of 60%, with an aqueous preparation which contains 60 g/l of paraffin containing a condensation product of hexamethylolmelamine hexamethyl ether and stearic acid, 15 g/l of aluminium triglycolate (in the form of a 25% aqueous solution) and 50 g/l of a mixture of bis- (perfluoroalkylmethyl)-ammonium phosphate, bis-(1H,1H-pentadecafluorooctyl)-ammonium phosphate, bis-(1H,1H,9H-hexadecafluorononyl)-ammonium phosphate and 1H,1H,2H,2H-heptadecafluorodecyl methacrylate (in the form of a 13% aqueous solution). The impregnated twill is dried, subjected to the heat treatment, washed, rinsed and again dried, as indicated in Example 1.

A portion of the twill is now after-treated with liquid ammonia, steamed and dried, as indicated in Example 1.

Both the twill after-treated with ammonia and the twill which has not been after-treaed have a rating of 5 in the Monsanto crease pattern according to SNV 198 670 (5 is the best and 1 the poorest rating) and a rating of 6 in the test to determine the oil repellency accoring to AATCC 118-1972 (8 is the best and 1 the poorest rating), and in the test to determine the absorption of water according to DIN 53 888 and according to the spray test AATCC 22-1971 are to be designated water-repellent.

The mechanical properties from the textile point of view were tested as indicated in Example 1 and the results are listed in Table VIII below.

TABLE VIII

| Mechanical properties from the textile point of view and colour strength | Twill not after-treated | Twill after-treated according to the invention | Relative difference % |
|---|---|---|---|
| Tear strength | | | |
| warp/2.5 cm daN | 59.3 | 67.5 | +13.8 |
| weft/2.5 cm daN | 42.0 | 44.5 | +5.9 |
| Tear propagation resistance | | | |
| weft | 5.85 | 5.42 | +0.1 |
| Stiffness mg cm | 658 | 586 | |

What is claimed is:

1. A process for flame-proofing cellulose-containing fibrous material which comprises the steps of (a) applying an aqueous composition which contains 200 to 400 g/l of at least one flameproofing agent selected from the group consisting of methylolated phosphonium salts, phosphonium hydroxides, their water-soluble condensation products with a compound which forms an aminoplast, methylolated alkylphosphonocarboxamides and their water-soluble polymers with a compound which forms an aminoplast, and 20 to 100 g/l of a compound which forms an aminoplast or of an aminoplast precondensate to the fiber and fixing, (b) washing and drying the material and (c) subjecting the material thus obtained to an after-treatment with liquid ammonia.

2. A process according to claim 1, in which the flame-proofing agent is selected from the group consisting of tetrakis-(hydroxymethyl)-phosphonium salts or condensation products thereof with urea and a N-methylolated dimethyl- or diethyl-phosphono-propionamide.

3. A process according to claim 1, in which the flame-proofing agent comprises a N-methylolated dimethyl- or diethylphosphono-propionamide, which is applied in the presence of a methylolated melamine which is unetherified or etherified with methyl or ethyl.

4. A process according to claim 1, in which the aqueous composition is applied to the fibrous material by the padding method.

5. A process according to claim 1, in which the flame-proofing agent is fixed on the fibrous material by the wet storage method, by the ammonia fixing method or by the thermofixing method.

6. A process according to claim 1, in which the flame-proofing agent is fixed by the thermofixing method, by drying the fibrous material at 60° to 100° C. and subjecting it to a heat treatment at 130° to 180° C. for 0.5 to 10 minutes.

7. A process according to claim 1, in which the fibrous material is washed with an aqueous solution which contains an acid-binding agent and optionally an oxidising agent and the material is dried at 60° to 100° C.

8. A process according to claim 1, in which the fibrous material is subjected to the after-treatment with liquid ammonia at a temperature not higher than −33° C.

9. A process according to claim 1, in which the fibrous material is subjected to the after-treatment with liquid ammonia by the padding method.

10. A process according to claim 1, in which the fibrous material is subjected to the after-treatment with liquid ammonia for 0.1 to 10 seconds.

11. A process according to claim 1, in which the fibrous material is subjected to the after-treatment with liquid ammonia whilst under tension.

12. A process according to claim 1, in which after the treatment under tension, the fibrous material is subjected to mechanical shrinking.

13. A process according to claim 1, in which the ammonia is removed after the after-treatment by steaming the fibrous material or by means of dry heat.

14. A process according to claim 1, in which the fibrous material is a mixture of cellulose fibers with up to 70 percent by weight of synthetic fibers of polyamide, polyacrylonitrile or polyester.

15. A process according to claim 1, in which the fibrous material is cotton fibers.

16. A process for the after-treatment of cellulose-containing, flameproofed fibrous materials, which have optionally been dyed and whitened and to which at least one flameproofing agent has previously been applied and fixed, and the fibrous materials have been washed and dried, which process comprises using liquid ammonia for the after-treatment.

17. A process according to claim 16, in which the flameproofed fibrous material is subjected to the after-treatment with liquid ammonia at a temperature not higher than −33° C. for 0.1 to 10 seconds.

18. A process according to claim 16, in which the flameproofed fibrous material is subjected to the after-treatment with liquid ammonia by the padding method optionally under tension and is optionally subjected to a subsequent mechanical shrinking.

19. Cellulose-containing, flameproofed fibrous material which has optionally been dyed and whitened and which has been subjected to a after-treatment with liquid ammonia by the process according to claims 1 or 16.

* * * * *